US009371981B2

(12) United States Patent
Chen

(10) Patent No.: US 9,371,981 B2
(45) Date of Patent: Jun. 21, 2016

(54) LED LAMP HAVING STABLE STRUCTURE AND EASY ASSEMBLY

(71) Applicant: Yu-Syuan Chen, New Taipei (TW)

(72) Inventor: Yu-Syuan Chen, New Taipei (TW)

( * ) Notice: Subject to any disclaimer, the term of this patent is extended or adjusted under 35 U.S.C. 154(b) by 79 days.

(21) Appl. No.: 14/496,415

(22) Filed: Sep. 25, 2014

(65) Prior Publication Data

US 2015/0153026 A1 Jun. 4, 2015

(30) Foreign Application Priority Data

Dec. 3, 2013 (TW) ..... 102222706 U

(51) Int. Cl.

| | |
|---|---|
| ***F21V 15/01*** | (2006.01) |
| ***F21K 99/00*** | (2016.01) |
| ***F21V 19/00*** | (2006.01) |
| *F21Y 101/02* | (2006.01) |
| *F21V 3/00* | (2015.01) |

(52) U.S. Cl.

CPC ..... *F21V 19/004* (2013.01); *F21K 9/135* (2013.01); *F21V 3/00* (2013.01); *F21Y 2101/02* (2013.01)

(58) Field of Classification Search

CPC ..... F21V 19/004; F21K 9/135

See application file for complete search history.

(56) References Cited

U.S. PATENT DOCUMENTS

| | | | | |
|---|---|---|---|---|
| 2010/0195335 | A1* | 8/2010 | Allen | F21K 9/135 362/309 |
| 2011/0286200 | A1* | 11/2011 | Iimura | F21K 9/135 362/84 |
| 2012/0268937 | A1* | 10/2012 | Lee | F21V 29/004 362/249.02 |
| 2012/0287652 | A1* | 11/2012 | Breidenassel | F21K 9/135 362/373 |
| 2014/0078723 | A1* | 3/2014 | Chen | F21K 9/135 362/184 |

* cited by examiner

*Primary Examiner* — Joseph L Williams

(74) *Attorney, Agent, or Firm* — Chun-Ming Shih; HDLS IPR Services

(57) ABSTRACT

An LED lamp includes a heat conductive housing, a light source module and a light-pervious cover. The interior of the heat conductive housing is provided with a heat conductive partition plate capable of dividing the interior of the heat conductive housing thereby forming an accommodation space having a cavity at one end of the heat conductive housing. The light source module is disposed in the accommodation space and includes a circuit board and at least one LED disposed on the circuit board. The light-pervious cover is formed with a sleeve opening, and the periphery of the sleeve opening is protrudingly formed with an annular wall, the outer edge of the annular wall is mated and engaged with the inner edge of the cavity, thereby enabling the circuit board to be pressed by the annular wall so as to be tightly fastened on the heat conductive partition plate.

12 Claims, 8 Drawing Sheets

LED LAMP HAVING STABLE STRUCTURE AND EASY ASSEMBLY

BACKGROUND OF THE INVENTION

1. Field of the Invention

The present invention relates to an LED lamp, especially to an LED lamp having a stable structure and an advantage of easy assembly.

2. Description of Related Art

A conventional bulb mainly includes a housing formed with a cavity, and a heat conductive partition plate used for the purpose of heat conduction is disposed inside the cavity for allowing a circuit board to be installed thereon, and a plurality of LEDs are disposed on the circuit board. Generally, the circuit board is fastened on the heat conductive partition plate through a locking or adhering means.

Because the bulb is often installed on a ceiling, the circuit board would be located at the bottom surface of the heat conductive partition plate. As such, if the circuit board is fastened through an adhering means, the heat generated by the LEDs would soften the adhering gel and the circuit board may be released from the heat conductive partition plate due to the gravity, so the heat dissipation for the circuit board is poor and the circuit board is very likely to be damaged. If the circuit board is fastened on the heat conductive partition plate through a locking means, the circuit board could be stably fastened and disposed, but the locking operation requires a manual force and additional assembly procedure thereby raising the production cost.

Accordingly, the applicant of the present invention has devoted himself for improving the mentioned disadvantage.

SUMMARY OF THE INVENTION

The present invention is to provide an LED lamp having a stable structure and an advantage of easy assembly.

Accordingly, the present invention provides an LED lamp, which includes a heat conductive housing, a light source module and a light-pervious cover. The interior of the heat conductive housing is provided with a heat conductive partition plate capable of dividing the interior of the heat conductive housing thereby forming an accommodation space at one end of the heat conductive housing, and the accommodation space is formed with a cavity. The light source module is disposed in the accommodation space and includes a circuit board and at least one LED disposed on the circuit board. The light-pervious cover is formed with a sleeve opening, and the periphery of the sleeve opening is protrudingly formed with an annular wall, the outer edge of the annular wall is mated and engaged with the inner edge of the cavity, thereby enabling the circuit board to be pressed and tightly fastened on the heat conductive partition plate.

Preferably, according to the mentioned LED lamp, the outer edge of the annular wall is protrudingly formed with a flange, and the inner edge of the cavity is protrudingly formed with a protruding part capable of being correspondingly engaged with the flange.

Preferably, according to the mentioned LED lamp, the maximum width of the circuit board is larger than the inner diameter of the annular wall.

Preferably, according to the mentioned LED lamp, the circuit board is formed as a circular board, and the annular wall is served to press the periphery of the circuit board.

Preferably, according to the mentioned LED lamp, the circuit board is formed as a polygonal board, and the annular wall is served to press at least one corner of the circuit board.

Preferably, according to the mentioned LED lamp, the circuit board is formed as a triangular board, and the annular wall is served to press at least one corner of the circuit board.

Preferably, according to the mentioned LED lamp, another end of the heat conductive housing is formed with a connection opening, and the connection opening is sleeved with a lamp holder.

Preferably, according to the mentioned LED lamp, two wires are disposed in the heat conductive housing, and two ends of each of the wires are respectively and electrically connected to the circuit board and the lamp header.

Preferably, according to the mentioned LED lamp, the heat conductive partition plate is formed with a penetrated hole allowing each of the wires to pass so as to be connected to the circuit board.

Preferably, according to the mentioned LED lamp, the circuit board is formed with a wire hole, and the location where the wire hole is formed is corresponding to the location where the penetrated hole is formed, so each of the wires is able to respectively pass the penetrated hole and the wire hole so as to be connected to the circuit board.

Preferably, according to the mentioned LED lamp, the light source module includes a plurality of LEDs, and the LEDs are all disposed on one surface of the circuit board.

Preferably, according to the mentioned LED lamp, another surface of the circuit board is adjacently disposed on the heat conductive partition plate.

Preferably, according to the mentioned LED lamp, a heat conductive member is disposed between the circuit board and the heat conductive partition plate.

According to the LED lamp provided by the present invention, the annular wall formed at the periphery of the sleeve opening of the light-pervious cover is able to be engaged with the heat conductive housing and the circuit board is able to be pressed at the same time. Comparing to prior art, the heat conductive housing and the light-pervious cover of the present invention are connected through an engaging means, so the assembly process is easier and faster. In addition, the light-pervious cover is enabled to press the circuit board, so the connecting structure is more stable, the service life is longer, and a connecting mechanism between the circuit board and the heat conductive partition plate is not required thereby lowering the production cost.

DETAILED DESCRIPTION OF THE INVENTION

Preferred embodiments of the present invention will be described with reference to the drawings.

Figure 1:
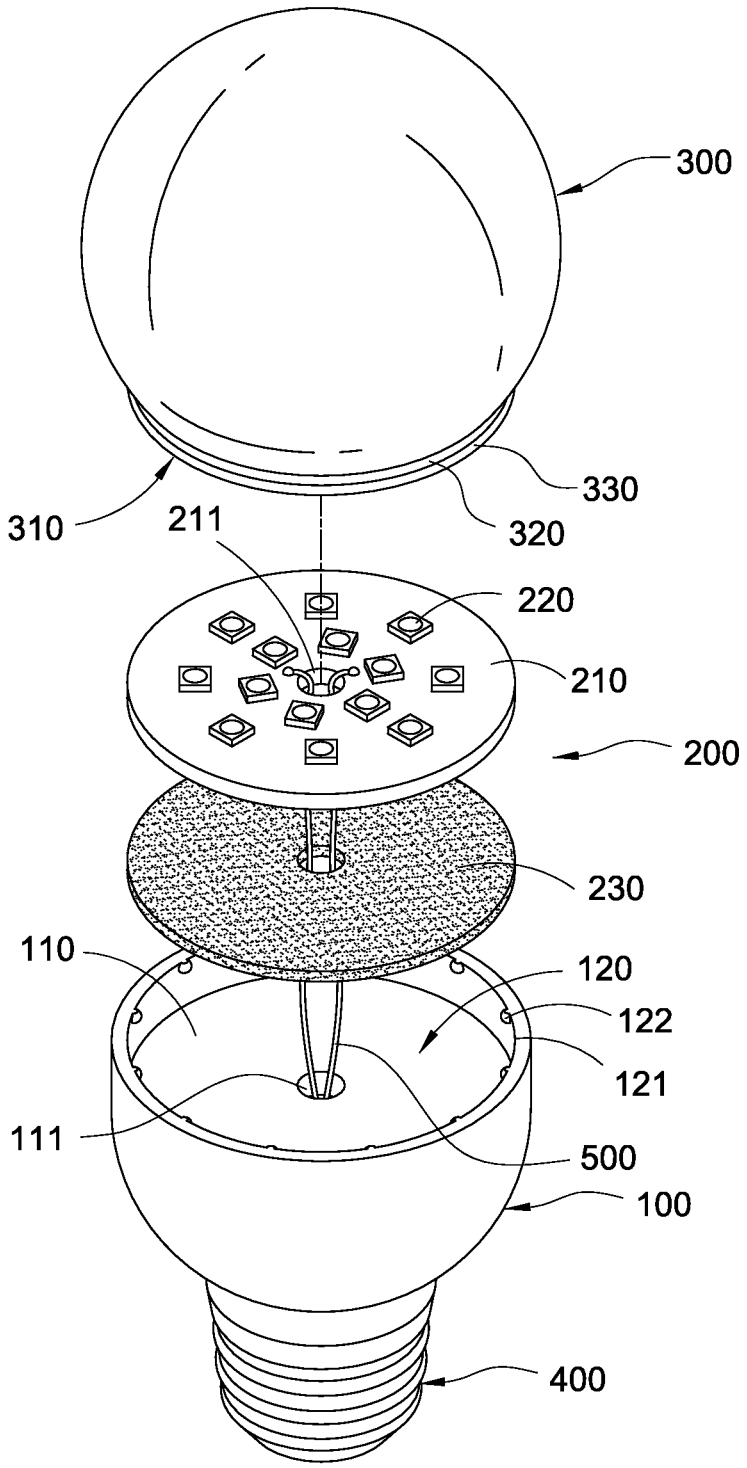
FIG. 1 is a perspective exploded view showing an LED lamp according to a first embodiment of the present invention.
Figure 2:
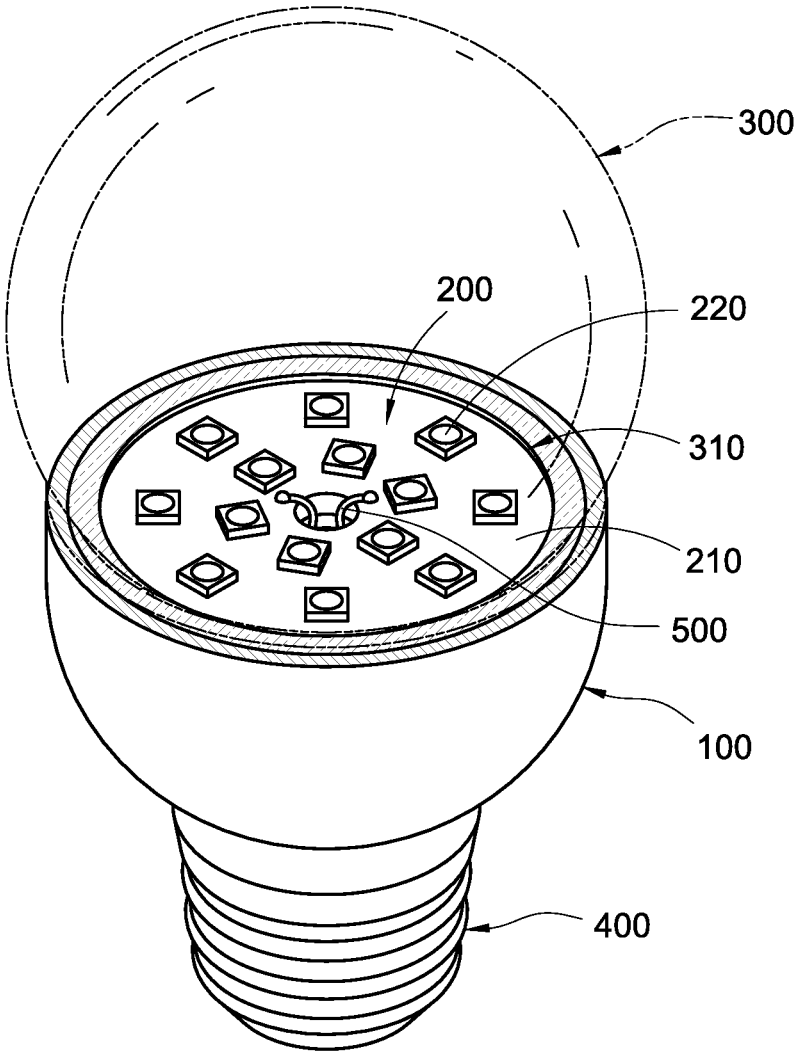
FIG. 2 is a perspective view showing the LED lamp according to the first embodiment of the present invention.
Figure 3:
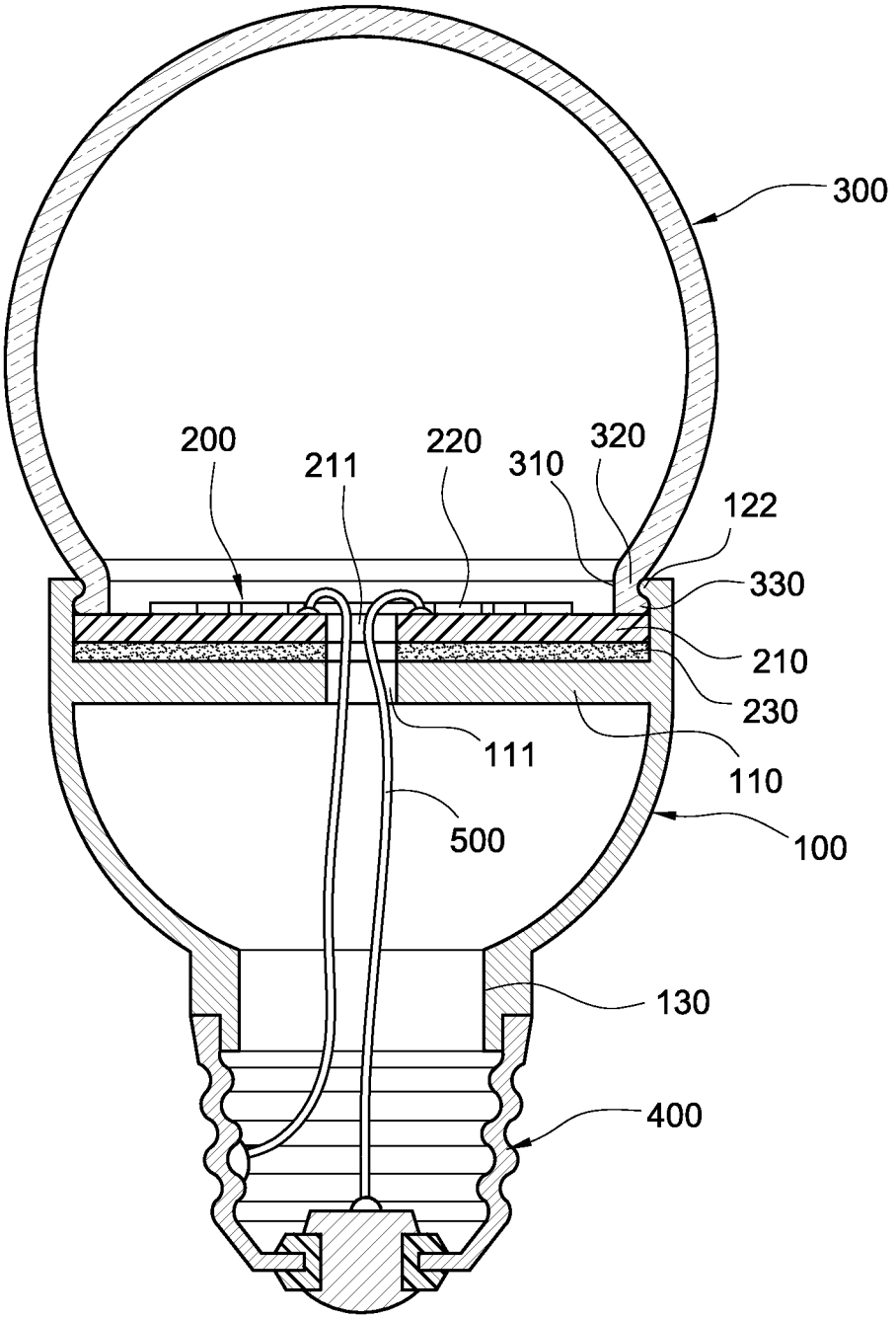
FIG. 3 is a longitudinal cross sectional view showing the LED lamp according to the first embodiment of the present invention.

Please refer from FIG. 1 to FIG. 3, according to a first embodiment provided by the present invention, an LED lamp includes a heat conductive housing 100, a light source module 200, a light-pervious cover 300, a lamp header 400 and two wires 500.

According to this embodiment, the heat conductive housing 100 is preferably to be formed as a hollow tubular body made of a metal or other materials having relatively higher heat conductivity, and the interior of the heat conductive housing 100 is provided with a heat conductive partition plate 110, wherein the heat conductive partition plate 110 is preferably to be made of a metal or other materials having relatively higher heat conductivity and integrally formed with the heat conductive housing 100. The heat conductive partition plate 110 is formed with a penetrated hole 111, and the heat conductive partition plate 110 is served to divide the interior of the heat conductive housing 100 thereby forming an accommodation space 120 at one end of the heat conductive housing 100. The accommodation space 120 is formed with a cavity 121, and another end of the heat conductive housing 100 is formed with a connection opening 130. An inner edge of the cavity 121 is protrudingly formed with a protruding part 122; according to this embodiment, the protruding part 122 is formed as a plurality of annularly-arranged convex columns, what shall be addressed is that the scope of the present invention is not limited to the above-mentioned arrangement, the protruding part 122 can also be formed as an annular rib protruded from the inner edge of the cavity 121.

The light source module 200 is disposed in the accommodation space 120, and includes a circular circuit board 210 and a plurality of LEDs 220. The circuit board 210 is formed with a wire hole 211, and the LEDs 220 are all disposed on one surface of the circuit board 210, and another surface of the circuit board 210 is adjacently disposed on the heat conductive partition plate 110.

According to this embodiment, the light-pervious cover 300 is formed as a light-pervious spherical hollow cover member made of glass or plastic, and formed in a transparent or translucent status. The light-pervious cover 300 is formed with a circular sleeve opening 310, and the periphery of the sleeve opening 310 is protrudingly formed with an annular wall 320. The outer edge of the annular wall 320 is laterally formed with a flange 330, and the maximum width (the diameter) of the circuit board 210 is larger than the inner diameter of the annular wall 320. The outer edge of the annular wall 320 is able to be mated and engaged with the inner edge of the cavity 121 of the heat conductive housing 100, thereby enabling the light-pervious cover 300 to cover the cavity 120 so as to cover the LEDs 220. The flange 330 is correspondingly engaged with the protruding part 122 at the inner edge of the cavity 121 thereby allowing the light-pervious cover 300 to be fastened in the cavity 121, and the periphery of the circuit board 210 is able to be pressed by the annular wall 320 thereby enabling the circuit board 210 to be tightly fastened and disposed on the heat conductive partition plate 110. A heat conductive member 230 is preferably to be disposed between the circuit board 210 and the heat conductive partition plate 110, what shall be addressed is that the scope of the present invention is not limited to the status of the heat conductive member 230, for example the heat conductive member 230 can be a thermo gel or a thermo pad, and the circuit board 210 can also be directly disposed on the heat conductive partition plate 110 without the installation of the heat conductive member 230. Accordingly, the heat generated while the LEDs 220 being operated is able to be effectively transferred to the heat conductive housing 100 through the heat conductive partition plate 110 (and the heat conductive member 230) so as to be dissipated to the air.

Figure 4:
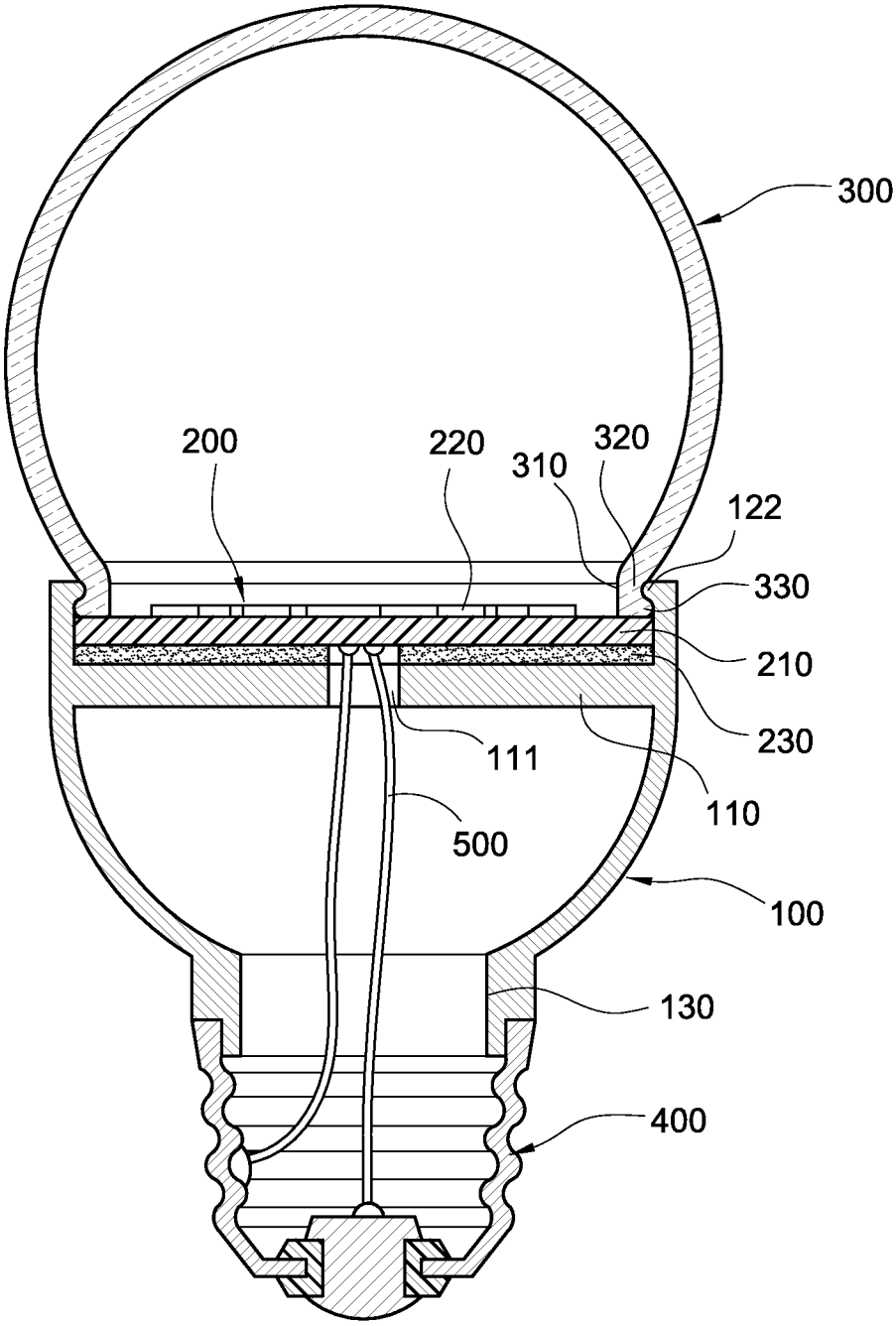
FIG. 4 is a schematic view showing another status of the LED lamp according to the first embodiment of the present invention.

An outer surface of the lamp header 400 is formed with threads for being threaded on a lamp holder so as to be electrically connected to a power source (for example the public power source). The lamp header 400 is sleeved with the connection opening 130 of the heat conductive housing 100. The two wires 500 are disposed in the heat conductive housing 100, and two ends of each of the wires 500 are respectively and electrically connected to the circuit board 210 and the lamp header 400. According to this embodiment, the location where the wire hole 211 of the circuit board 210 is formed is corresponding to the location where the penetrated hole 111 of the heat conductive partition plate 110 is formed, so each of the wires 500 is able to respectively pass the penetrated hole 111 and the wire hole 211 and to be welded on the surface of the circuit board 210 where the LEDs 220 are disposed. What shall be addressed is the scope with the present invention is not limited to the above mentioned arrangement; please refer to FIG. 4 as an example, each of the wires 500 can respectively pass the penetrated hole 111 of the heat conductive partition plate 110 and be welded on the surface of the circuit board 210 which is adjacently disposed on the heat conductive partition plate 110. Accordingly, through the two wires 500 being electrically connected to the circuit board 210, the lamp header 400 is enabled to supply electric power to each of the LEDs 220 for driving each of the LEDs 220 to emit lights.

Figure 5:
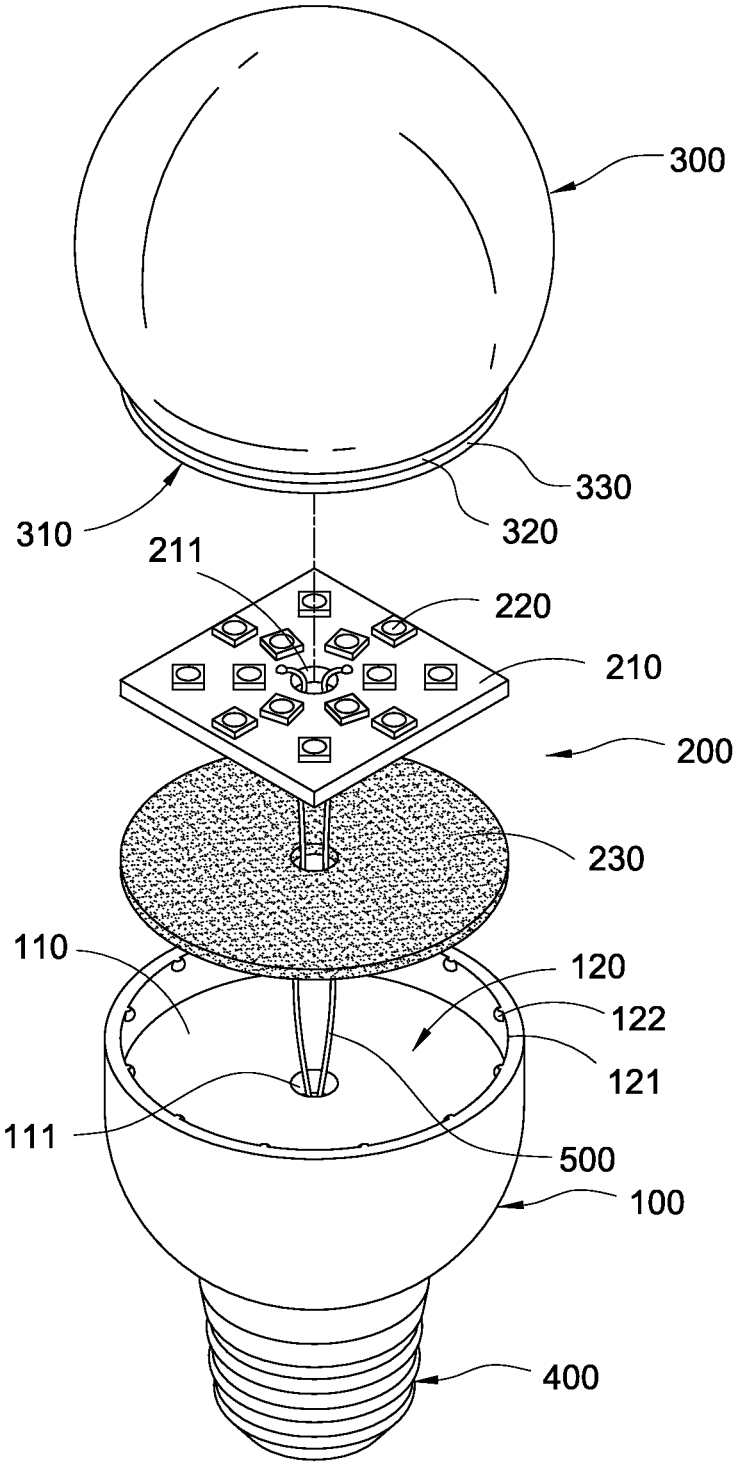
FIG. 5 is a perspective exploded view showing an LED lamp according to a second embodiment of the present invention.
Figure 6:
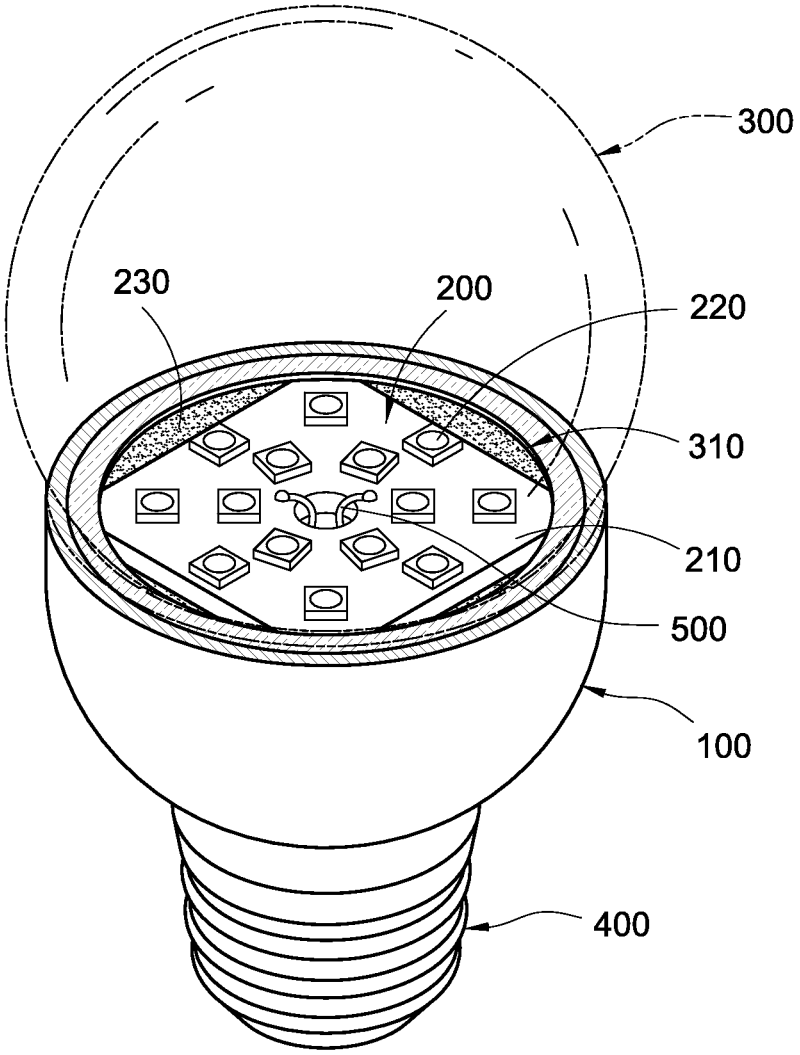
FIG. 6 is a perspective view showing the LED lamp according to the second embodiment of the present invention.

Please refer to FIG. 5 and FIG. 6, according to a second embodiment provided by the present invention, an LED lamp includes a heat conductive housing 100, a light source module 200, a light-pervious cover 300, a lamp header 400 and two wires 500. The structure disposed in the second embodiment is substantially the same as the structure disclosed in the first embodiment, and the difference between the two is that the circuit board 210 is formed as a polygonal board; according to this embodiment, the polygonal board is preferably to be a rectangular board, and the maximum width (the diagonal distance) of the circuit board 210 is larger than the inner diameter of the annular wall 320, and the annular wall 320 is served to press at least one corner of the circuit board 210 (according to this embodiment, the annular wall 320 is preferably to be served to press each corner of the circuit board 210), thereby allowing the circuit board 210 to be fastened and disposed on the heat conductive partition plate 110.

Figure 7:
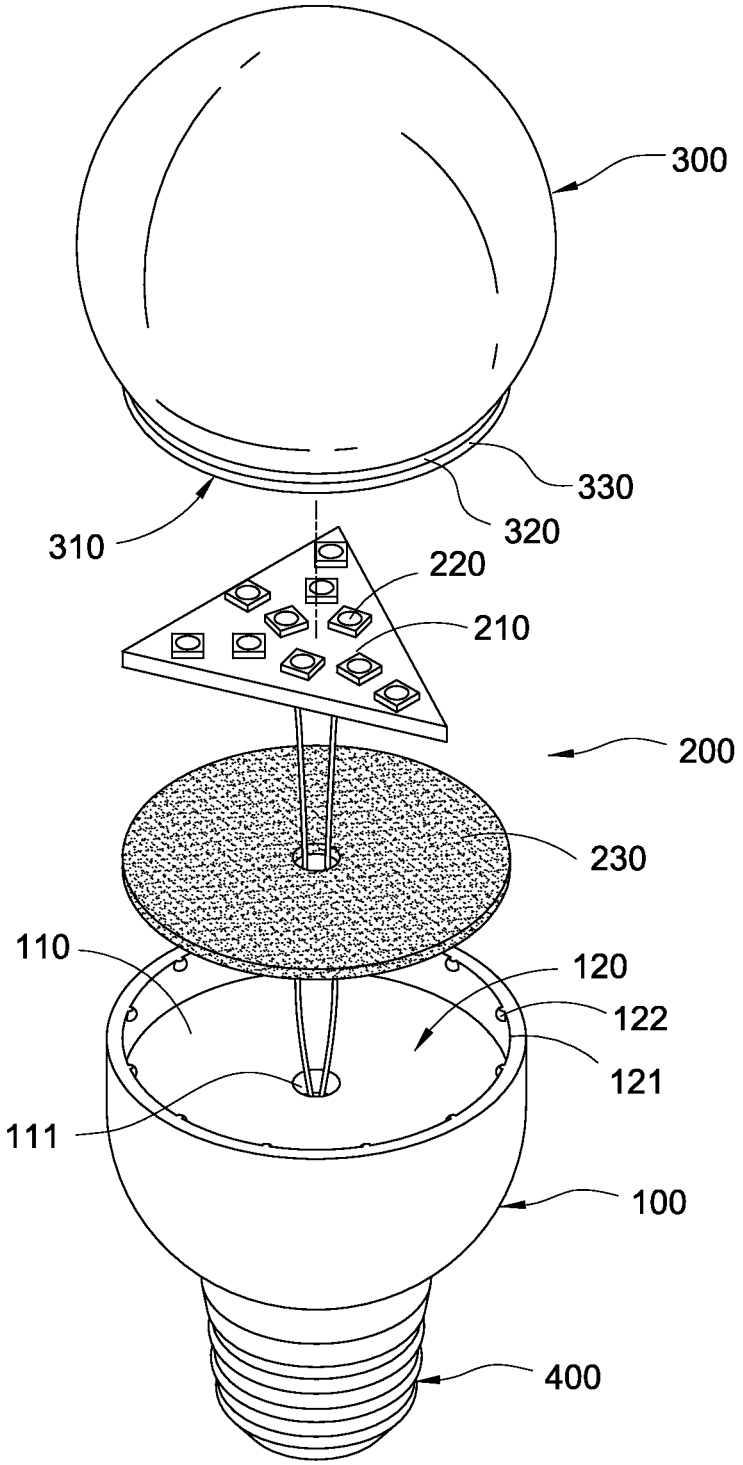
FIG. 7 is a perspective exploded view showing an LED lamp according to a third embodiment of the present invention.
Figure 8:
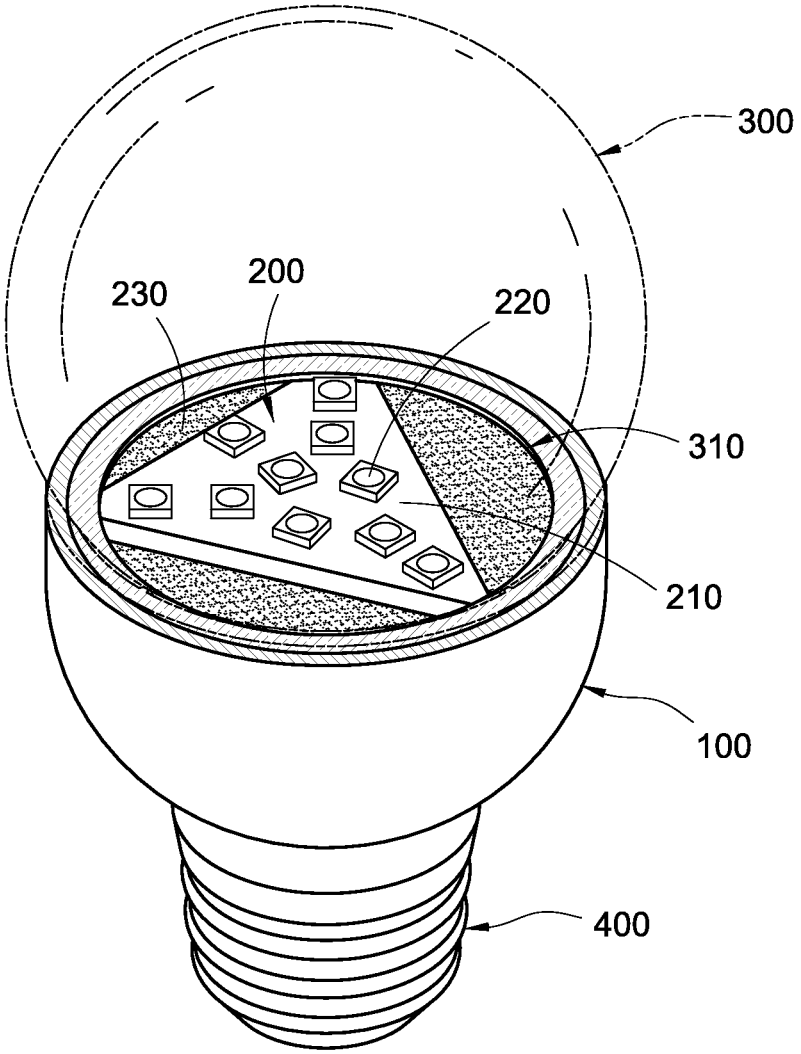
FIG. 8 is a perspective view showing the LED lamp according to the third embodiment of the present invention.

Please refer to FIG. 7 and FIG. 8, according to a third embodiment provided by the present invention, an LED lamp includes a heat conductive housing 100, a light source module 200, a light-pervious cover 300, a lamp header 400 and two wires 500. The structure disposed in the third embodiment is substantially the same as the structure disclosed in the first embodiment, and the difference between the two is that the circuit board 210 is formed as a triangular board, and the annular wall 320 is served to press at least one corner of the circuit board 210 (according to this embodiment, the annular wall 320 is preferably to be served to press each corner of the circuit board 210), thereby allowing the circuit board 210 to be fastened and disposed on the heat conductive partition plate 110.

According to the LED lamp provided by the present invention, the annular wall 320 formed at the periphery of the sleeve opening 310 of the light-pervious cover 300 is able to be engaged with the heat conductive housing 100, and the circuit board 210 is able to be pressed and disposed on the heat conductive partition plate 110 at the same time. Comparing to prior art, the heat conductive housing 100 and the light-pervious cover 300 of the present invention are connected through an engaging means, so the assembly process is easier and faster. In addition, the light-pervious cover 300 is enabled to press the circuit board 210, so the connecting structure is more stable, the service life is longer, and a connecting mechanism between the circuit board 210 and the heat conductive partition plate 110 is not required thereby lowering the production cost.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An LED lamp, including:

a heat conductive housing, formed in a tubular status, and the interior thereof being provided with a heat conductive partition plate capable of dividing the interior of the heat conductive housing thereby forming an accommodation space at one end of the heat conductive housing, wherein the accommodation space is formed with a cavity;

a light source module, disposed in the accommodation space, and including a circuit board and at least one LED disposed on the circuit board; and a light-pervious cover, formed with a sleeve opening, and the periphery of the sleeve opening being protrudingly formed with an annular wall, wherein the outer edge of the annular wall is mated and engaged with the inner edge of the cavity, thereby enabling the circuit board to be pressed by the annular wall so as to be adjacently disposed and tightly fastened on the heat conductive partition plate, wherein a heat conductive member is disposed between the circuit board and the heat conductive partition plate.

2. The LED lamp according to claim 1, wherein the outer edge of the annular wall is protrudingly formed with a flange, and the inner edge of the cavity is protrudingly formed with a protruding part capable of being correspondingly engaged with the flange.

3. The LED lamp according to claim 1, wherein the maximum width of the circuit board is larger than the inner diameter of the annular wall.

4. The LED lamp according to claim 3, wherein the circuit board is formed as a circular board, and the annular wall is served to press the periphery of the circuit board.

5. The LED lamp according to claim 3, wherein the circuit board is formed as a polygonal board, and the annular wall is served to press at least one corner of the circuit board.

6. The LED lamp according to claim 1, wherein the circuit board is formed as a triangular board, and the annular wall is served to press at least one corner of the circuit board.

7. The LED lamp according to claim 1, wherein another end of the heat conductive housing is formed with a connection opening which is sleeved with a lamp holder.

8. The LED lamp according to claim 7, wherein two wires are disposed in the heat conductive housing, and two ends of each of the wires are respectively and electrically connected to the circuit board and the lamp header.

9. The LED lamp according to claim 8, wherein the heat conductive partition plate is formed with a penetrated hole allowing each of the wires to pass so as to be connected to the circuit board.

10. The LED lamp according to claim 9, wherein the circuit board is formed with a wire hole, and the location where the wire hole is formed is corresponding to the location where the penetrated hole is formed, so each of the wires is able to respectively pass the penetrated hole and the wire hole so as to be connected to the circuit board.

11. The LED lamp according to claim 1, wherein the light source module includes a plurality of LEDs, and the LEDs are all disposed on one surface of the circuit board.

12. The LED lamp according to claim 11, wherein another surface of the circuit board is adjacently disposed on the heat conductive partition plate.

* * * * *